United States Patent [19]

Kisling

[11] Patent Number: 4,582,467

[45] Date of Patent: Apr. 15, 1986

[54] TWO STAGE ROTOR ASSEMBLY WITH IMPROVED COOLANT FLOW

[75] Inventor: Douglas L. Kisling, Palm Beach Gardens, Fla.

[73] Assignee: United Technologies Corporation, Hartford, Conn.

[21] Appl. No.: 742,637

[22] Filed: Jun. 10, 1985

Related U.S. Application Data

[63] Continuation of Ser. No. 564,454, Dec. 22, 1983, abandoned.

[51] Int. Cl.[4] ..... F01D 5/08; F01D 5/18

[52] U.S. Cl. ..... 416/95; 416/97 A; 415/115

[58] Field of Search ..... 416/95, 96 R, 96 A, 416/97 R, 97 A, 193 A, 90 R, 91; 415/115, 172 A, 178, 180, 199.4, 199.5

[56] References Cited

U.S. PATENT DOCUMENTS

| | | | |
|---|---|---|---|
| 2,656,147 | 10/1953 | Brownhill et al. | 416/97 R |
| 2,858,103 | 10/1958 | Waugh | 416/97 R |
| 3,056,579 | 10/1962 | Bobo | 416/96 R |
| 3,706,508 | 12/1972 | Moskowitz et al. | 416/96 A |
| 4,021,138 | 5/1977 | Scalzo et al. | 416/193 A |
| 4,309,147 | 1/1982 | Koster et al. | 416/95 |

FOREIGN PATENT DOCUMENTS

| | | | |
|---|---|---|---|
| 0619018 | 4/1961 | Canada | 416/97 R |
| 1076446 | 2/1960 | Fed. Rep. of Germany | 416/95 |
| 0350836 | 1/1961 | Switzerland | 416/95 |
| 0737167 | 9/1955 | United Kingdom | 416/95 |
| 0988541 | 4/1965 | United Kingdom | 416/95 |

*Primary Examiner*—Robert E. Garrett
*Assistant Examiner*—H. Edward Li
*Attorney, Agent, or Firm*—Stephen E. Revis

[57] ABSTRACT

A spacer extends between and engages the rear face of a first disk and front face of a second disk of co-rotating rotors of a two stage turbine. The spacer engages the disks radially inwardly of the blade root slots of each disk and defines an intermediate cooling air compartment between the disks, radially inward of the spacer. Each disk includes blade root slots, each having a blade root disposed therein and defining a cooling air passageway across each slot from the front to rear face of each disk. Cooling air from a compartment upstream of the first disk is directed downstream through the passageways across the slots and thence radially inwardly into the intermediate compartment between the disks. From the intermediate compartment the cooling air travels radially outwardly and then axially through the cooling air passageways across the second disk blade root slots. Thus, the same mass of cooling air from upstream of the first disk is used to cool the rims of both disks and the blade roots disposed in the slots of both disks without the air having to pass through axial holes through the first disk, thereby eliminating the need for such holes and increasing the strength of the disk. In a preferred embodiment a portion of the cooling air passing through the slots of each disk is directed radially outwardly into hollow airfoils which are integral with the blade roots.

1 Claim, 7 Drawing Figures

TWO STAGE ROTOR ASSEMBLY WITH IMPROVED COOLANT FLOW

The Government has the rights in this invention pursuant to Contract No. F33657-82-C-0003 awarded by the Department of the Air Force.

This is a continuation of application Ser. No. 564,454 filed Dec. 22, 1983, abandoned.

DESCRIPTION

1. Technical Field

This invention relates to gas turbine engine rotors, and more particularly to rotor disk and blade root cooling.

2. Background Art

In the hot, turbine section of a gas turbine engine it is required that the roots of turbine blades and the live rim of the turbine disk and the disk lugs be cooled during engine operation. This has typically been accomplished by passing cooling air across the disk through axial passageways formed in the blade root slot between the blade root inner end and the disk live rim. The cooling air flow passes once through the slot in a downstream direction and empties into a compartment on the downstream side of the disk.

It is also usual for gas turbine engine turbine airfoils to be "hollow"; that is, to have passageways and/or compartments therewithin for the flow of cooling air therethrough to maintain the airfoil temperature below a predetermined level. It is known in the prior art to meter a portion of cooling air from upstream of the disk into the hollow airfoils via radially extending passageways through the enlarged rim portion of the disk. These metering passageways communicate with radially extending channels through the blade roots which feed the hollow airfoils.

In a two stage turbine, both stages are cooled using cooling air from a compartment upstream of the first stage disk. The cooling air for the second stage disk rim and blades is conducted from this upstream compartment, via axial holes in the first disk, into an intermediate compartment formed between the first and second stage disks. The cooling air is then passed, for example, from the intermediate compartment into the hollow airfoils of the second stage rotor via metering passageways extending substantially radially through the enlarged rim portion of the disk. The metering passageways communicate with channels through the blade roots which feed the hollow airfoils.

It is desirable to minimize the amount of cooling air flow needed to maintain acceptable part operating temperatures since this improves engine efficiency. It is also desirable to avoid putting holes through the disks, since these holes weaken the disk and limit its life.

DISCLOSURE OF INVENTION

One object of the present invention is a two stage turbine assembly with improved means for bringing cooling air to the rims and blades of both turbine rotors.

According to the present invention, a two stage turbine has a first stage disk with a plurality of circumferentially spaced apart blade root slots extending axially therethrough about the periphery thereof and having blades disposed therein, and a second stage disk with a plurality of circumferentially spaced apart blade root slots extending axially therethrough about the periphery thereof and having blades disposed therein, wherein spacer means extends between and engages the two disks defining an intermediate cooling air compartment therebetween radially inwardly of the blade root slots, said disks and spacer means being constructed and arranged wherein cooling air from a compartment upstream of the first disk travels through the blade root slots of the first disk to the rear side of the first disk and thence radially inwardly into the said intermediate compartment between the disks from whence it flows into and through the blade root slots of the second disk to the rear side thereof.

In a preferred embodiment, the airfoils are hollow and a metered portion of the cooling air passing through the blade root slots of each disk is directed radially outwardly into internal compartments of the hollow airfoils via radially extending channels through the blade roots.

An important feature of the present invention is the elimination of the axial holes through the first disk which were used, in the prior art to bring cooling air downstream to the second stage disk.

BEST MODE FOR CARRYING OUT THE INVENTION

Figure 1:
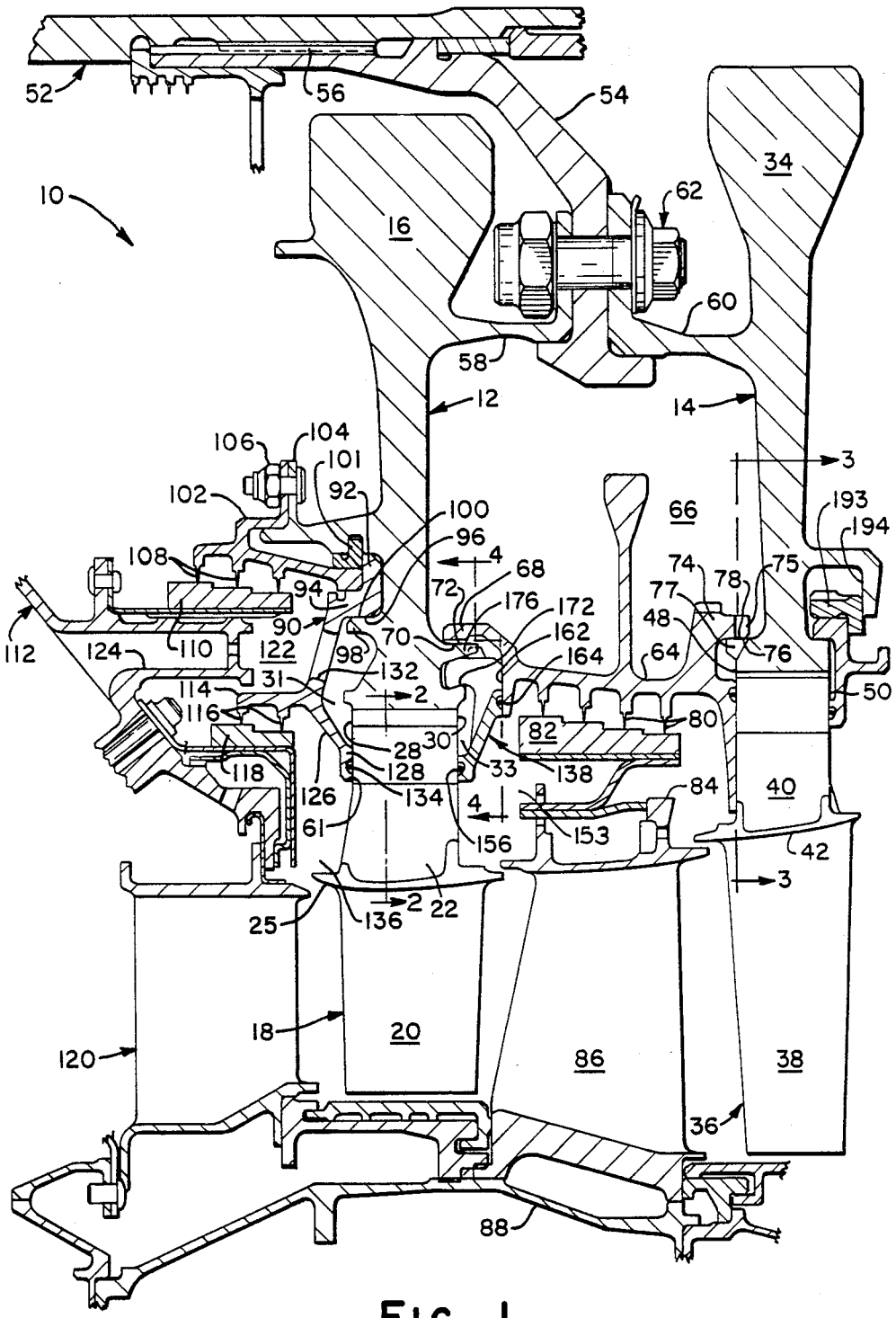
FIG. 1 is a simplified sectional view of the turbine section of a gas turbine engine incorporating the features of the present invention.

As an exemplary embodiment of the present invention consider the portion of the turbine section of a gas turbine engine, the turbine section being generally represented by the reference numeral 10 in FIG. 1. Only the first two stages are shown. The first stage rotor assembly is generally represented by the reference numeral 12. The second stage rotor assembly is generally represented by the reference numeral 14.

Figure 2:
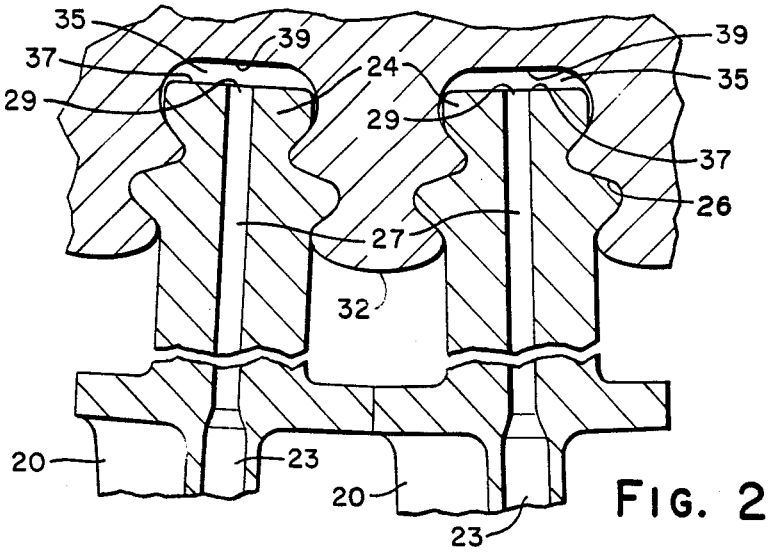
FIG. 2 is a sectional view taken generally along the line 2—2 of FIG. 1.

The first rotor assembly 12 comprises a disk 16 having a plurality of blades 18 circumferentially spaced about the periphery thereof. Each blade 18 comprises a root portion 22 and an airfoil portion 20 having a platform 25 integral therewith. With reference also to FIG. 2, the root portion 22 has a fir-tree shaped root end 24 disposed in a similarly shaped fir-tree slot 26 which extends axially through the disk 16 from the disk front face 28 to the disk rear face 30. The slots 26 are formed between what are herein referred to as disk lugs 32. Axially extending cooling air passageways 35 are formed between the innermost end surface 37 of the root end 24 and the live rim 39 of the disk 16. These passageways 35 are for carrying cooling air through the slots 26 from a front annular space 31 on the front side of the disk 16 into a rear annular space 33 on the rear side of the disk 16 to cool the blade root ends 24, the disk lugs 32, and the live rim 39 of the disk 16. A portion of the cooling air flowing through the passageways 35 is diverted into cooling air passageways or compartments 23 within the airfoils 20 via channels 27 through the blade root ends 24. The channels 27 have inlets 29 which communicate directly with the passageways 35 through the slots 26.

Figure 3:
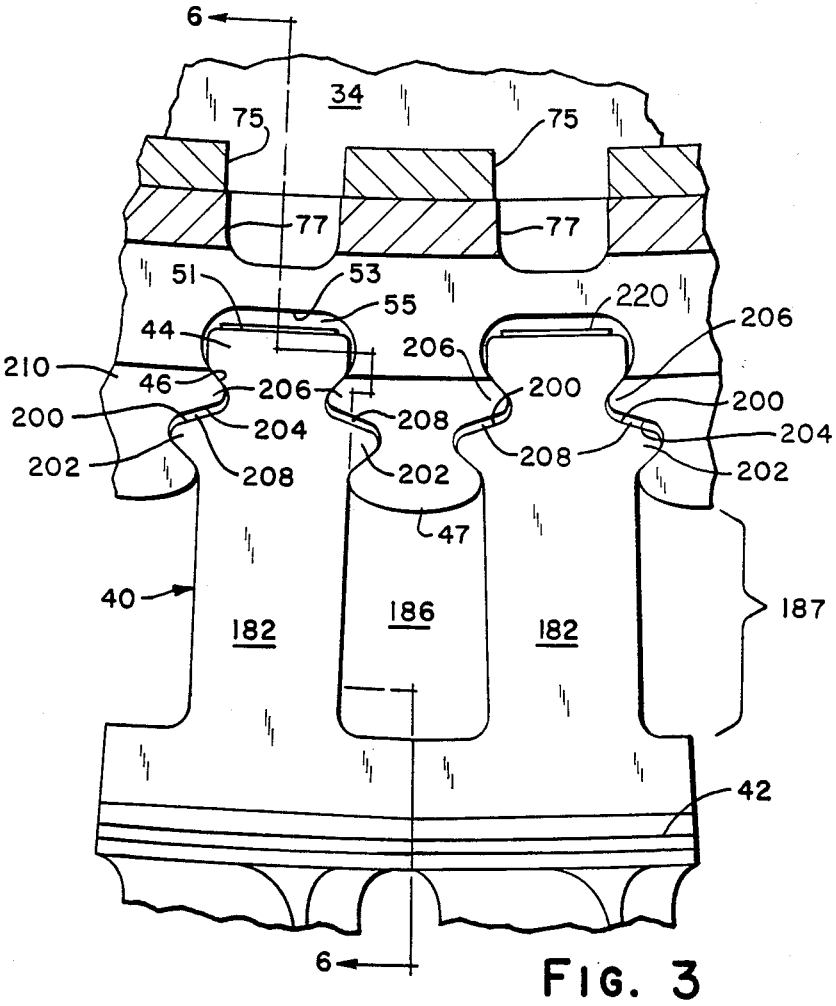
FIG. 3 is a sectional view taken generally along the line 3—3 of FIG. 1.

The second rotor assembly 14 comprises a disk 34 having a plurality of blades 36 circumferentially spaced about the periphery thereof. As best shown in FIGS. 1 and 3, each blade 36 comprises a root portion 40 and an airfoil portion 38 having a platform 42 integral therewith. The root portion 40 includes a fir-tree shaped root end 44 disposed in similarly shaped fir-tree slots 46 formed between disk lugs 47. The slots 46 extend axially through the disk 34 from the disk front face 48 to the disk rear face 50. The innermost, radially inwardly facing surface 51 of each root end 44 is spaced radially from the radially outwardly facing bottom surface 53 of the slot 46, whIch is also the live rim of the disk 34. A first axially extending cooling air passageway 55 is thereby formed therebetween for carrying cooling air through the disk slot 46 from a compartment, such as the compartment 66 on the front side of the disk 34 to an annular space 57 on the rear side of the disk 34. Further aspects of the cooling configuration for second stage disk and blades will be described hereinbelow.

The disks 16, 34 are connected to an engine shaft assembly 52 through an annular support member 54 which is splined to the shaft assembly 52 as at 56. More specifically, the disk 16 includes a flanged cylindrical support arm 58, and the disk 34 includes a flanged cylindrical support arm 60. The flanged arms 58, 60 are secured to the support member 54 by suitable means, such as a plurality of nut and bolt assemblies 62.

An annular spacer 64 is disposed radially outwardly of the flanged support arms 58, 60 and extends axially between the rear face 30 of the first stage disk 16 and the front face 48 of the second stage disk 34 defining an intermediate annular cooling air compartment 66 radially outwardly of the support arms and which extends axially between the rear face 30 and the front face 48. The forward end 68 of the spacer 64 includes a radially outwardly facing cylindrical surface 70 which engages a corresponding radially inwardly facing cylindrical surface 72 of the rear face 30. The cylindrical surface 70 includes a plurality of circumferentially spaced apart scallops or cutouts 71 (see FIG. 4) extending axially thereacross for metering a flow of cooling air from the rear cooling air space 33 into the intermediate compartment 66, as will be further explained hereinbelow. Similarly, the rearward end 74 of the spacer 64 includes a radially outwardly facing cylindrical surface 76 which engages a corresponding radially inwardly facing cylindrical surface 78 of the front face 48 of the disk 34. The spacer 64 is thus supported radially by the disks 16, 34 and rotates therewith. A plurality of circumferentially spaced apart radial slots 75 in the rearward end 74 are aligned with a plurality of circumferentially spaced apart radial slots 77 in the front face 48 of the disk 34 to form passageways for the flow of cooling air from the compartment 66 into and through the first cooling air passageways 55 within the blade root slots 46.

In this embodiment the spacer 64 carries a plurality of radially outwardly extending knife edges 80 which are closely spaced from a stationary annular seal land 82. The seal land 82 is supported, through suitable structure, from the inner ends 84 of a plurality of circumferentially spaced stator vanes 86 disposed between the first and second stage rotor airfoils 20, 38, respectively. The vanes 86 are supported from an outer engine casing 88.

Secured to the front face 28 of the disk 16 is an annular blade retaining plate 90. More specifically, the radially inner end 92 of the plate 90 includes an axially extending flange 94 having a radially outwardly facing cylindrical surface 96. The front face 28 of the disk 16 includes an axially extending flange 98 having a radially inwardly facing cylindrical surface 100. The surface 96 mates with the surface 100 to orient and support the plate 90 radially relative to the disk 16. The plate 90 is trapped axially in position by a split ring 101 and an inner annular seal carrier 102 which is bolted to a radially inwardly extending flange 104 of the disk 16, such as by bolts 106. The seal carrier 102 includes a plurality of conventional, radially outwardly extending knife edges 108 which are in sealing relationship to a stationary annular seal land 110 secured to stationary structure generally represented by the reference numeral 112.

The plate 90 also include an axially extending cylindrical seal carrier 114 integral therewith and which carries a plurality of conventional, radially outwardly extending knife edges 116. The knife edges 116 are in sealing relationship with a stationary annular seal land 118 secured to the stationary structure 112. The stationary structure 112 cooperates with a stage of stator vanes 120 disposed in the gas path upstream of the rotor blades 20. The vanes 120 are secured by suitable means to the engine outer case 88.

The plate 90 further includes a frusto-conical portion 126 extending radially outwardly in a downstream direction. The frusto-conical portion 126 has a radially outer end 128. The end 128 includes an annular surface 61 facing axially downstream which abuts the front face 28 of the disk 16 and the fir-tree shaped blade root ends 24. With reference to FIG. 1, the seal carriers 102, 114, the plate 90, and the stationary structure 112 define an inner annular compartment 122 which is fed cooling air from a plurality of circumferentially spaced apart nozzles 124. The plate 90, between its inner and outer ends 92, 128, stands away from the disks front face 28 defining the annular cooling air space 31 which, through large holes 132 in the plate 90, is in fluid communication with and is, in effect, a part of the compartment 122. The knife edges 116 and a wire seal 134 between the plate end 128 and disk face 28 prevent leakage from the compartments 122, 31 radially outwardly into an outer gas space 136.

Figure 5:
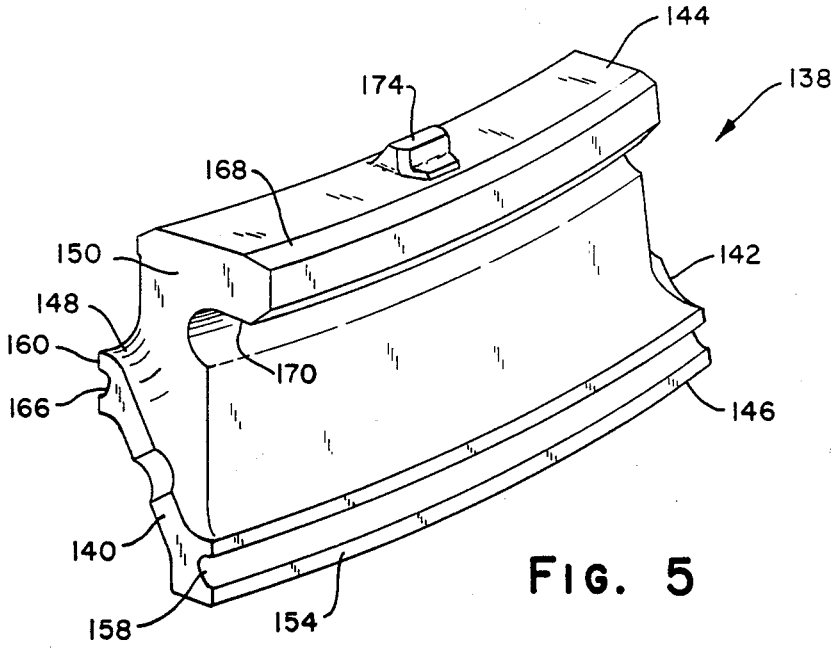
FIG. 5 is a perspective view, looking generally rearward, of one segment of the annular rear blade retainer for the first stage turbine rotor.

Secured to the rear face 30 of the first disk 16 are a plurality of blade retaining segments 138 circumferentially disposed about the engine axis. One of these blade retaining segments 138 is shown in perspective in FIG. 5. Each segment 138 includes oppositely facing end surfaces 140, 142. The end surfaces 140 abut the end surfaces 142 of adjacent segments to form a segmented full annular member. The segments 138 are trapped axially between the spacer 64 and the rear face 30 of the first disk 16 to define the hereinabove referred to rear annular cooling air space 33 which receives the cooling air flowing through the passageways 35 within the blade root slots 26. A forwardly facing, circumferentially extending surface 154 near the radially outermost edge 146 of each segment 138 bears against the disk face 30 (actually the lugs 32) and the end faces of the fir tree shaped blade roots to form a full annular seal, which seal is improved by a wire seal 156 disposed in an annular groove formed by arcuate groove segments 158 in each of the blade retaining segments 138. Similarly, rearwardly facing arcuate surface segments 160 bear against the forwardly facing annular surface 162 of the spacer 64 and, along with a wire seal 164 disposed in the annular groove defined by arcuate groove segments 166 (FIG. 5), form a full annular seal against the surface 162.

Figure 4:
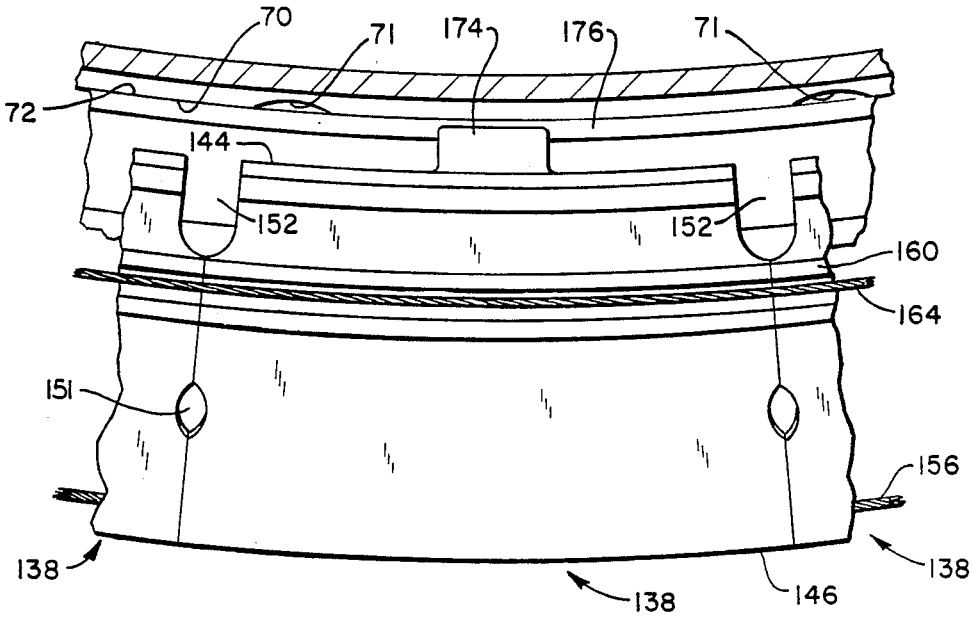
FIG. 4 is a sectional view taken generally along the line 4—4 of FIG. 1.

Each end face 140, 142 is cut back or stepped, as at 148, such that a surface 150 is formed parallel to but is out of the plane of its respective end surface 140, 142. The surfaces 150 extends from the innermost edge 144 of the segment 138 to the step 148. Slots 152, best seen in FIG. 4, are thereby formed between the abutting segments 138. The slots 152 provide fluid flow communication between the gas space 33 and the intermediate compartment 66, via the hereinabove referred to metering cutouts 71 in the forward end 68 of the spacer 64. Metering holes 151 (FIG. 4) formed between abutting segments 138 provide fluid flow communication between the gas space 33 and outer annular compartment 153. The cooling air flowing into the compartment 153 is used to cool the knife edges 80 and seal land 82.

The blade retaining segments 138 are supported and positioned radially by a forwardly extending arcuate lip 168 having a radially outwardly facing surface 170 which rests on a radially inwardly facing cylindrical surface 172 of the disk 16. A lug 174 on each segment 138 engages a rearwardly extending annular flange 176 of the disk 16 to further position the segments 138 both axially and radially relative to the disk 16.

The second stage disk 34 also includes blade retaining means on both the front and rear sides thereof. In this embodiment, the spacer 64 is also the front side blade retainer. More specifically, the rearward end of the spacer 64 includes a radially outwardly extending annular coverplate 178 having a rear surface 180 which abuts the front surfaces of the lugs 47 and the front surfaces 182 of the blade root portions 40. These front surfaces are substantially coplanar. The coverplate 178 extends radially outwardly to the blade platforms 42 such that it completely covers or closes off the forward end of the space or volume 186 defined between the extended portions 187 of the root portions 40.

The blades are prevented from axially rearward movement by an annular rear coverplate 188. The rear coverplate 188 has an annular, forwardly extending lip 190 which snaps over a shoulder 192 on the rear side of the disk 34 thereby supporting and positioning the coverplate radially. The rear coverplate is trapped axially by a split annular ring 193 which engages the radially innermost end of the coverplate 188 and fits tightly between it and a radially outwardly extending annular flange 194 of the disk 34. The radially outermost end 196 of the coverplate 188 includes a forwardly facing annular surface 198 which forms an annular seal against the substantially coplanar rearwardly facing surfaces of the disk lugs 47 and the rearwardly facing surfaces of the blade root ends 44. Between the snap diameter at the shoulder 192 and the seal at the surface 198 the cover plate 188 is spaced axially from the rear face 50 of the disk 34 to define the previously referred to annular gas space 57 therebetween.

Figure 6:
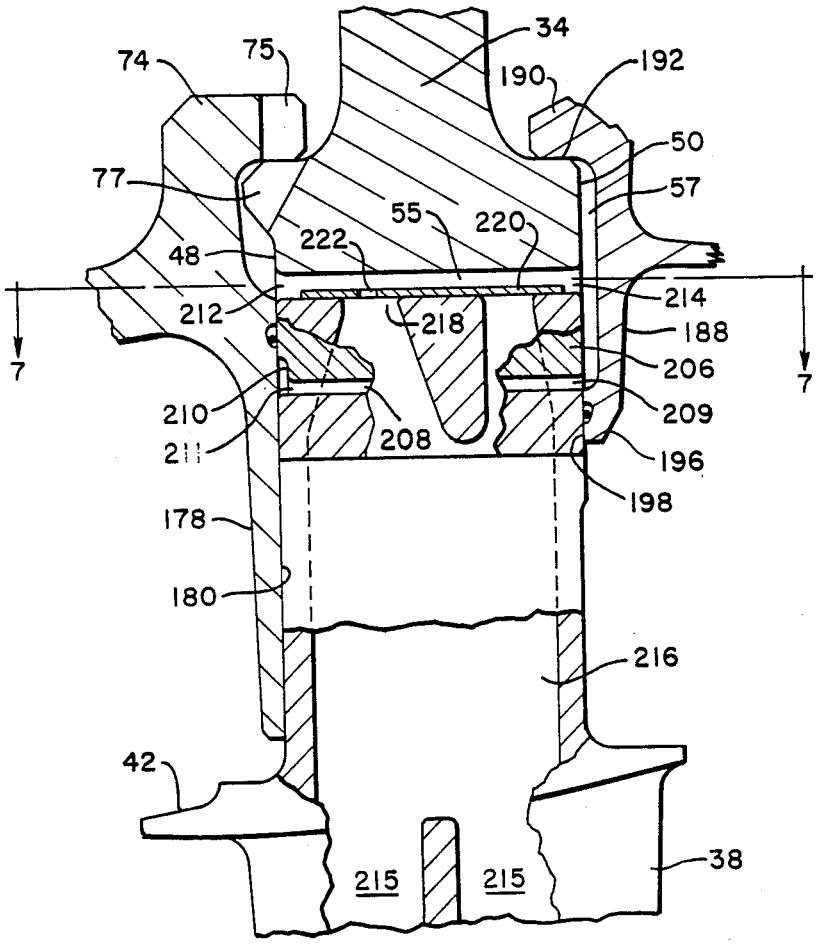
FIG. 6 is a sectional view partly broken away, taken generally along the line 6—6 of FIG. 3.

As best shown in FIGS. 3 and 6, the radially inwardly facing surfaces 200 of the outer teeth 202 of the root portion 40 are spaced radially outwardly from the corresponding opposed surfaces 204 of the disk lug inner teeth 206 to define second air cooling passageways 208 through the slots 46. These passageways have inlets 209 at the rear face 50 of the disk 34 which communicate with the gas space 57. The radially outermost portion of the front face of each lug 47 is cut back slightly as at 210 so as to be spaced slightly from the surface 180 of the coverplate 178 to provide fluid communication between outlets 211 of the second cooling air passageways 208 and the spaces 186 between the blade root portions 40.

The first cooling air passageways 55 have inlets 212 and outlets 214. The inlets 212 communicate, through the slots 75, 77, with the intermediate cooling air compartment 66 between the first and second rotor disks 16, 34. The outlets 214 open into the gas space 57 on the rear side of the disk 34. The first and second passageways 55, 208 are in series fluid flow relation through the gas space 57. Because the pressure in the intermediate compartment 66 is higher than the pressure in the spaces 186, the cooling air flows from the compartment 66 through the first passageways 55 into the gas space 57 and thence, in the opposite, forward direction, through the second cooling air passageways 208. The air then flows into the spaces 186 via the cutouts 210 in the lugs 47. From the spaces 186 the cooling air travels into another compartment (not shown) located downstream thereof. The cutouts 210 are sized to meter the flow of cooling air through the blade root slots 46.

Figure 7:
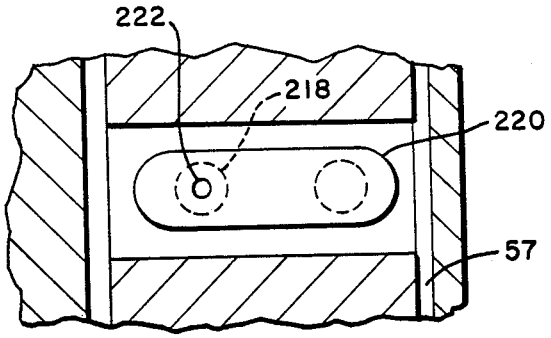
FIG. 7 is a sectional view taken generally along the line 7—7 of FIG. 6.

Referring to FIGS. 6 and 7, in a preferred embodiment, the second stage airfoils 38 have cooling air passageways or compartments 215 therein which are fed cooling air from the intermediate compartment 66 between the disk 16, 34 via a radially extending channel 216 through the blade root portion 40. The channel 216 interconnects the airfoil compartments 215 and the first cooling air passageway 55 through the root slot 46. An inlet 218 to the channel 216 is covered by a thin plate 220. The plate 220 has a metering orifice 222 therethrough aligned with the channel inlet 218 for metering the appropriate amount of flow from the first passageway 55 into the airfoil compartments 215. The air flowing into the compartments 215 leaves the airfoil via holes and slots (not shown) through the airfoil wall for cooling the same, as is well known in the art. During rotor operation, the pressure in the compartments 215 is lower than the pressure in the intermediate cooling air compartment 66 such that the airflow is in the proper direction.

Considering the turbine section 10 as a whole, a novel cooling arrangement has been provided whereby cooling air from a compartment upstream of the first stage rotor disk 16 is used to cool the first and second stage disk lugs, live rims, blade roots and airfoils. This turbine section construction is particularly unique in that it requires no life limiting holes through the first stage disk to get cooling air from upstream thereof to the second stage blade roots and into the second stage airfoils 38. Furthermore, the unique double pass cooling air flow arrangement through the second stage blade root area reduces the cooling air mass flow requirements for cooling the second stage disk rim, lugs and blade roots by twenty-six percent (26%).

Although the invention has been shown and described with respect to a preferred embodiment thereof, it should be understood by those skilled in the art that other various changes and omissions in the form and detail thereof may be made therein without departing from the spirit and the scope of the invention.

I claim:

1. A rotor assembly comprising first and second coaxial, co-rotating gas turbine engine rotors, each including a disk having a front face, a rear face, a live rim, and a plurality of lugs circumferentially spaced about and extending radially outwardly from said rim, a blade root slot being defined between circumferentially adjacent lugs, said slots extending axially from said front to rear face;

a plurality of circumferentially spaced apart stator vanes disposed between said rotors and having radially inner ends;

a stationary annular seal land supported by said stator vane inner ends;

means associated with said first rotor front face defining a front compartment for receiving a supply of cooling air;

spacer means, comprising an axially extending annular member having a forward end and a rearward end, said forward end including a radially outwardly facing circumferentially extending surface, said first disk rear face including a radially inwardly facing circumferentially extending surface located radially inwardly of said first disk slots and engaging said radially outwardly facing surface to define a first substantially cylindrical interface therebetween, said rearward end including a radially outwardly facing circumferentially extending surface, said second disk front face including a radially inwardly facing circumferentially extending surface located radially inwardly of said second disk slots and engaging said radially outwardly facing surface of said rearward end defining a second substantially cylindrical interface therebetween, said spacer means and rotor disks defining an intermediate annular cooling air compartment radially inwardly of said spacer means and extending axially between said rear and front disk faces, said spacer means including at least one annular knife edge seal extending radially outwardly from said annular member and in sealing relation to said seal land;

said rotors each including a plurality of rotor blades, each blade having a root, one of said roots being disposed in each of said slots and defining, with its respective slot, an axial cooling air passageway through said slot from said front to rear face of its respective disk; and cover plate means downstream of said first disk and in contact with said first disk rear face defining a first rear compartment between said intermediate compartment and said axial cooling air passageways through said first disk slots, wherein said first disk and said spacer means includes means defining openings at said first interface to meter cooling air flow from said passageways through said first disk slots into said intermediate compartment, and said second disk and said spacer means includes means defining opening at said second interface for the flow of cooling air from said intermediate compartment into said cooling air passageways through said second rotor disk slots, and wherein said front compartment, said passageways through said first rotor disk slots, said first rear compartment, said intermediate cooling air compartment, and said passageways through said second rotor disk slots are in series fluid flow relationship, whereby cooling air flows from said front compartment into and through said first rotor disk slots, from said first rotor disk slots into said first rear compartment, from said first rear compartment radially inwardly into said intermediate cooling air compartment, and from said intermediate cooling air compartment radially outwardly and into and through said second rotor disk slots.

* * * * *